US007103938B2

(12) United States Patent
Brückner et al.

(10) Patent No.: US 7,103,938 B2
(45) Date of Patent: Sep. 12, 2006

(54) MOTOR VEHICLE DOOR HINGE

(75) Inventors: Lothar Brückner, Leonberg (DE); Wolfgang Garbe, Remscheid (DE); Nils Magnus, Remscheid (DE)

(73) Assignee: Edscha AG, Remscheid (DE)

( * ) Notice: Subject to any disclaimer, the term of this patent is extended or adjusted under 35 U.S.C. 154(b) by 35 days.

(21) Appl. No.: 10/474,568

(22) PCT Filed: Apr. 12, 2002

(86) PCT No.: PCT/DE02/01374

§ 371 (c)(1),
(2), (4) Date: May 19, 2004

(87) PCT Pub. No.: WO02/084058

PCT Pub. Date: Oct. 24, 2002

(65) Prior Publication Data

US 2004/0187260 A1 Sep. 30, 2004

(30) Foreign Application Priority Data

Apr. 12, 2001 (DE) ..... 101 18 301

(51) Int. Cl.
*E05D 11/10* (2006.01)

(52) U.S. Cl. ..... 16/334; 16/335; 16/332

(58) Field of Classification Search ..... 16/334, 16/335, 332, 330, 328, 329, 331, 352, 353, 16/312, 314, 299, 300; 296/146.12, 146.11, 296/169; 292/DIG. 17, DIG. 22
See application file for complete search history.

(56) References Cited

U.S. PATENT DOCUMENTS 4,332,055 A 6/1982 Rudnick et al. ..... 16/335
4,532,675 A * 8/1985 Salazar ..... 16/335
4,756,055 A * 7/1988 Welsch et al. ..... 16/260
4,766,643 A 8/1988 Salazar ..... 16/222
4,829,633 A * 5/1989 Kassner ..... 16/322
5,092,017 A 3/1992 Hatano et al. ..... 16/2

(Continued)

FOREIGN PATENT DOCUMENTS

DE 2342945 3/1974

(Continued)

*Primary Examiner*—Chuck Y. Mah
*Assistant Examiner*—Mark T. Vogelbacker
(74) *Attorney, Agent, or Firm*—Davidson, Davidson & Kappel, LLC

(57) ABSTRACT

The invention relates to a motor vehicle door hinge comprised of a first hinge part (2), a second hinge part (3), a shaft section (4), which joins a hinge eye (10) of the first hinge part (2) and a hinge eye (17) of the second hinge part (17) to one another in an articulated manner, and of a door arrester unit (25), which produces a holding force that is to be surmounted by tensioning a spring unit (32). Preferred holding angles of the door arrester unit (25) are stipulated by detent markings. The aim of the invention is to create a motor vehicle door hinge that can be economically produced and mounted. To this end, the hinge parts (2, 3) are provided in the form of U-shaped sheet metal shaped parts with hinge eyes (10, 11; 17, 18) that are placed in limbs (6, 7; 15, 16) of the hinge parts (2, 3), and the shaft section (4) is prevented from rotating with the one (26) of the cam disk (30) and detent disk (26) that is subjected to the action of the spring unit (32), whereas the other (30) of the cam disk (30) and detent disk (26) is joined in a non-rotatable manner to the hinge part (3) in which the shaft section can rotate.

37 Claims, 4 Drawing Sheets

U.S. PATENT DOCUMENTS

| | | | | | |
|---|---|---|---|---|---|
| 5,570,498 | A | * | 11/1996 | Hipkiss et al. | 16/258 |
| 5,774,938 | A | | 7/1998 | Kent et al. | 16/332 |
| 5,878,463 | A | * | 3/1999 | Kluting et al. | 16/334 |
| 5,913,350 | A | * | 6/1999 | Kluting | 16/334 |
| 5,920,960 | A | * | 7/1999 | Kluting | 16/334 |
| 5,924,170 | A | * | 7/1999 | Papke et al. | 16/321 |
| 6,000,098 | A | * | 12/1999 | Kluting | 16/334 |
| 6,012,201 | A | * | 1/2000 | Mitts et al. | 16/334 |
| 6,029,314 | A | * | 2/2000 | Kluting et al. | 16/334 |
| 6,070,296 | A | | 6/2000 | Abeln et al. | 16/261 |
| 6,073,309 | A | * | 6/2000 | Kluting et al. | 16/334 |
| 6,200,591 | B1 | | 3/2001 | Hussain et al. | 424/434 |
| 6,591,451 | B1 | * | 7/2003 | Gruber et al. | 16/262 |
| 6,817,062 | B1 | * | 11/2004 | Cho | 16/328 |

FOREIGN PATENT DOCUMENTS

| | | | | |
|---|---|---|---|---|
| DE | 69016052 | | | 8/1990 |
| DE | 19626928 | | | 2/1998 |
| DE | 19626928 | A1 | * | 2/1998 |
| DE | 19700075 | | | 6/1998 |
| DE | 29812357 | | | 12/1998 |
| DE | 19734841 | | | 2/1999 |
| DE | 19831085 | | | 4/1999 |
| DE | 19831085 | A1 | * | 4/1999 |
| DE | 19936280 | | | 2/2000 |
| DE | 19901263 | | | 7/2000 |
| DE | 19901263 | A1 | * | 7/2000 |
| DE | 10052040 | A1 | * | 4/2002 |
| EP | 0275641 | | | 7/1988 |
| EP | 0382170 | | | 8/1990 |
| EP | 0848128 | | | 6/1998 |
| EP | 0931897 | | | 7/1999 |
| EP | 931897 | A1 | * | 7/1999 |
| EP | 0897044 | | | 4/2003 |
| FR | 2212851 | A | * | 8/1974 |
| FR | 2670530 | A1 | * | 6/1992 |
| FR | 2864011 | A1 | * | 6/2005 |
| GB | 1437454 | A | * | 5/1976 |
| GB | 1524075 | | | 9/1978 |

* cited by examiner

MOTOR VEHICLE DOOR HINGE

The invention relates to a motor vehicle door hinge including a first hinge part which can optionally be fixed on one of the door assembly parts—door and door pillar, a second hinge part which can be fixed on the other of the two door assembly parts and which is arranged in a manner such that it can pivot with respect to the first hinge part about a hinge axis, a shaft section which connects a gudgeon of the first hinge part and a gudgeon of the second hinge part to each other in an articulated manner, and a door arrester unit which produces a retaining force which is to be overcome by tensioning a spring unit, wherein preferred retaining angles of the door arrester unit are defined by latching markings in a latching disk, in which at least one immovable cam which protrudes from a cam disk can engage.

BACKGROUND

EP-A-0 931 897 describes a motor vehicle door hinge, in which a first and a second hinge part in each case in the form of a single section and designed as a profiled and forged hinge part are connected to each other in a pivoting articulated manner via a common hinge pin. The hinge can be unhinged by the hinge pin being designed in a manner such that it can be taken out of that hinge part in which the hinge pin is held in a rotationally fixed manner, by releasing a nut. The hinge pin is to be designed to be of an appropriate length. The hinge furthermore comprises an arrester unit which comprises a cam disk, which is secured in a rotationally fixed manner on the outwardly directed end joint of that hinge part through which the hinge pin passes in a pivotable manner by means of a sleeve, and a corrugated disk, which is coupled to the hinge pin via a driver profile and is prestressed in the direction of the cam disk by a disk spring assembly, as a result of which the arresting or braking movement is provided by the relative movement of the corrugated disk and cam disk. The first problem with the known motor vehicle door hinge is the complicated subdivision of the arrester unit into cam disk and corrugated disk, this having to be provided, however, in order to put the disk springs favorably to use. The configuration as a separable motor vehicle door hinge means that the single-section hinge parts, the gudgeons of which absorb the entire load, have to be designed as forged parts or complicated profiles, with the production costs being considerable as a result. In particular, the manufacturing of a hinge pin with a multiplicity of profiles for securing it on the one hinge half, for screwing on the hinge pin tightly and for driving the corrugated disk is complicated and cost-intensive, in particular when taking the tolerances into consideration. Finally, the driving of the corrugated disk via the hinge pin, which is designed with a square bar profile, causes an unfavorable tendency for jamming to occur, as a result of which the axial movability of the corrugated disk is restricted and, in particular in the case of latching movements, there is an unfavorable surface pressure in the narrow region of the corrugated disk. Furthermore—as in other hinges known from practice—a rolled bushing is provided as the sliding bushing, the collar of which is produced by crimping and, as is generally known, has a triangular interruption and therefore a reduced contact area, the crimping causing undesired fluctuations in the thickness in the collar region which also has a disadvantageous effect on the running characteristics of the hinge, such as reduced adhesion of the sliding layer, and so, in series manufacturing, undesirably high tolerances and running fluctuations have to be accepted, and, moreover, the sealing against penetration of impurities from the surroundings is not entirely ensured.

EP-A-0 897 044 describes two types of door hinges comprising two hinge parts which are connected to each other in an articulated manner by a shaft section and are designed with an arresting device, which is provided outside the hinge parts and is provided coaxially on that part of the hinge pin which protrudes over the hinge parts. In a first embodiment, a cage is held by rolling bodies, which are designed as tapered rollers, on a housing which is connected to a hinge part while a latching disk, which is acted upon by a helical spring supported against the housing and has latching markings for the rolling bodies, is carried along by the shaft section and is rotated relative to the cage. In a second embodiment, a latching disk with latching markings for rolling bodies is secured on a housing connected to a hinge part or on a housing connected with the hinge part, and a cage with rolling bodies designed as tapered rollers or balls is carried along by the shaft section and rotated relative to the latching disk, in which case a pressure-distributing ring is acted upon by a spring, which is supported against a supporting plate, in the direction of the rolling bodies in order to press the rolling bodies into the latching markings, the cage and the pressure-distributing ring both having to be moved for this purpose up and down counter to the restoring force of the spring. Both embodiments require a complicated mounting of the multiplicity of mutually rotatable disks by means of ball bearings or the like which are placed in between, and furthermore require the provision of moveable rolling bodies, the rolling resistance of which slackens off severely over time, which means that the characteristic of the arrester unit differs significantly from the original setting. At the same time, this and also the diameters of the rolling bodies cause the arrester unit to have an undesirably large overall height. The parts to be manufactured are numerous and some of them have geometries which can be obtained only in a complicated manner, which means that production and installation are complicated.

EP-A-0 382 170 describes a motor vehicle door hinge, in which the two hinge parts each have two gudgeons which are connected to each other in an articulated manner via the same hinge pin, the hinge pin being secured in a rotationally fixed manner in the two gudgeons of the one hinge part and being mounted in a pivotable manner in the two gudgeons of the other hinge part. This motor vehicle door hinge does not permit any preferred securing at certain opening angles of the motor vehicle door; furthermore, the known hinge requires wings which are deposited outside the base of the parts having the gudgeons and in which the apertures for fixing it onto the door assembly parts are provided.

U.S. Pat. No. 4,332,055 describes a furniture hinge with two U-shaped hinge parts which each have a base with apertures for fixing said hinge onto a wall element and from which in each case two limbs protrude at right angles, the hinge parts being connected to each other via gudgeons, which are provided in the limbs, in a paired manner in each case by means of rivets, the furniture hinge furthermore securing a spring wire on the one hinge part and it being possible for its free ends to interact with projections provided on the other hinge part in order to hold a completely opened or completely closed position of the wall element. Among the disadvantages of the known furniture hinge is that the hinge axis is at the same large distance from both of the hinge parts. The use of a hinge of this type is not suitable in the case of a heavy motor vehicle door.

DE-A-2 342 945 describes a hinge, in which two hinge parts are connected to each other in an articulated manner by a hinge pin, two plate bodies outside the hinge parts enclosing a spring which pushes the two plate bodies apart, the hinge pin passing rotatably through the spring and the two plate bodies, the two plate bodies having a recess by which they are secured on a shaft, which is attached to the one hinge part, in such a manner that the plate bodies are carried along by this hinge part, the hinge pin furthermore having studs which engage around the plate bodies from the outside, protrude over the diameter of the hinge pin and interact with latching markings, which are formed in those sides of the plate bodies which face the studs, and are intended for the engagement of the studs, in such a manner that, when a stud is engaged in an appropriate position, corresponding, for example, to a holding position of a door, the spring is relaxed and, when the position is left, the spring is tensioned. Since the studs are placed fixedly in the hinge pin, the plate bodies have to be designed in a manner such that they can be displaced relative to the hinge pin and therefore also relative to the shaft, which is used to carry along the plate bodies, which means that there is a risk of jamming and, furthermore, of noises being produced. The structural space required by the known device is undesirably large in terms of height and width and furthermore lacks protection against the penetration of impurities. For the assembly, a separate installation aid is required because the studs can only be driven through the hinge pin at the end.

DE-A-198 31 085 describes a hinge with two hinge parts which are designed in each case as an outer and an inner bracket, in which a hinge pin passes through the two limbs of the two brackets, in which, in order to realize an arresting device, a spring which is supported against the one limb of the outer bracket acts upon the sleeve arranged on the hinge pin, and in which, furthermore, two divided tube sections are provided around the hinge pin, said sections being secured in each case by their mutually remote ends on one of the brackets and their mutually facing end sides having an intermeshing cam-type profile comprising depressions and projections running along a closed ring, the spring forcing the two tube sections in each case into positions in which all of the depressions and projections of the one tube section intermesh with all of the projections and depressions of the other tube section. One of the disadvantages of this hinge is the complicated production and installation, with the arresting device also resulting in the hinge axis having an unfavorable and thick configuration, and therefore needing to be at a large distance from the respective base of the brackets. Furthermore, it is inevitable that the one bracket with the associated tube section be inevitably displaced axially relative to the hinge pin during the opening movement, this not being acceptable for a motor vehicle hinge.

EP-A-0 848 128 describes a hinge comprising two hinge parts which are connected to each other in an articulated manner by a shaft section and are designed with an arresting device which is provided outside the hinge parts and is provided coaxially on that part of the hinge pin which protrudes over the hinge parts. In this case, a latching disk with latching markings for rolling bodies is secured on a housing, which is connected to a hinge part, and is decoupled from the hinge pin via a needle bearing. A complicated bearing unit for rolling bodies designed as tapered rollers is carried along in the rotational movement by a supporting plate, which is connected to the shaft section, via intermeshing projections of the supporting plate and recesses of the bearing unit, in which case a sleeve supports the bearing unit for an axial movement relative to the shaft section, which is cylindrical there. For this purpose, the bottom of the recesses in the bearing unit is at a distance from the projections of the supporting plate, which distance restricts the axial displaceability of the bearing plate. One end of a spring unit is supported against the supporting plate, the spring unit using its other end to prestress a shoulder of the bearing unit, the shoulder supporting the rolling bodies via a rigid connection. The carrying-along of the bearing unit via the supporting plate is problematic because there is a risk of it becoming jammed. The arrester unit furthermore requires a complicated mounting of the moveable rolling bodies, the rolling resistance of which severely slackens off over time, as a result of which the characteristic of the arrester unit significantly differs from the original setting. At the same time, the complicated design of the bearing unit and also the diameters of the rolling bodies result in the arrester unit having an undesirably large overall height. The parts which are to be manufactured are numerous and some of them have geometries which can only be obtained in a complicated manner, which means that production and installation are complicated.

DE-A-199 01 263 describes a hinge, in which two hinge parts are connected to each other in an articulated manner by a hinge pin, an arrester unit which is provided outside the hinge parts comprising a disk spring assembly which is arranged concentrically around the hinge pin on an extension thereof and has revolving balls and disks which are designed with recesses in order to carry along said balls, the vertical movement taking place along the hinge pin via longitudinal grooves formed in the latter and being blocked by brake plates.

DE-A-199 36 280 describes a hinge with two hinge parts and a hinge pin connecting said hinge parts, in which an arrester unit which is prestressed by a spring is provided outside the hinge pin and, by means of rollers which are provided at both ends of the arrester unit, presses against running surfaces, which are formed with profiled structures and are provided in addition to the hinge parts.

SUMMARY OF THE INVENTION

It is an object of the invention to provide a motor vehicle door hinge that can be produced and fitted cost-effectively.

The present invention provides a motor vehicle door hinge including a first hinge part which can optionally be fixed on one of the door assembly parts—door and door pillar, a second hinge part which can be fixed on the other of the two door assembly parts and which is arranged in a manner such that it can pivot with respect to the first hinge part about a hinge axis, a shaft section which connects a gudgeon of the first hinge part and a gudgeon of the second hinge part to each other in an articulated manner, and a door arrester unit which produces a retaining force which is to be overcome by tensioning a spring unit, wherein preferred retaining angles of the door arrester unit are defined by latching markings in a latching disk, in which at least one immovable cam which protrudes from a cam disk can engage. The first hinge part and the second hinge part are in each case designed as U-shaped sheet-metal shaped parts with a base and with a first limb and a second limb arranged in each case at right angles to the base, the limbs each having gudgeons, that the first limb of the first hinge part is connected in an articulated manner to the first limb of the second hinge part, that the second limb of the first hinge part is connected via the shaft section to the second limb of the second hinge part, and that the shaft section is secured by the one disk of the cam disk and the latching disk which are acted upon by the spring unit, against mutual rotation while the other disk of the cam disk and latching disk is connected nonrotatably to that hinge part in which the shaft section is rotatable.

The motor vehicle door hinge according to the invention provides, using simple means and without a complicated unhinging function, a favorable latching mechanism which can be produced at reasonable cost and the weight of which is, moreover, low. The hinge parts are designed as sheet-metal parts and can be produced cost-effectively using simple machining methods. The advantageous configuration as U-shaped sheet-metal shaped parts enables the load of the door to be distributed to the articulation points of the gudgeons, of which there are two in each case, apertures for fixing the hinge parts being formed in an advantageously space-saving manner in the base of the U-shaped sheet-metal shaped part, so that an axial projecting length which disadvantageously increases the overall height of the structural space is not required for fixing them on. Furthermore, the advantageous configuration as U-shaped sheet-metal shaped parts advantageously enables a nesting, i.e. an intermeshing, of the two hinge parts and also an overlapping, i.e. in which the limbs and the end joints are arranged in an alternating manner, to be provided, as a result of which the overall height of the motor vehicle door hinge turns out to be similarly compact.

The configuration of the hinge parts as sheet-metal shaped parts makes it possible at the same time for a stop to be formed in a simple manner by production of a bend in the extension of one of the limbs of one of the two hinge parts, said stop restricting the maximum door opening angle. The arrester unit is preferably attached on one side of one of the limbs of one of the two hinge parts, which side faces away from the other hinge part. This enables an arrester unit to be provided which is arranged outside the pivoting region of the other hinge part and is therefore not in the way of its pivoting movement. As an alternative, it is advantageously possible, in order to reduce the overall height, to arrange the arrester unit in a region between the two limbs lying opposite the base of one of the two hinge parts, as a result of which the overall height is reduced overall and the clearance can be used advantageously.

The cam disk has at least one, preferably three or four, immovable cams which protrude in the direction of the latching disk and preferably run radially with respect to the hinge axis, with respect to which the two disks mentioned are arranged perpendicularly. The latching disk has, for each cam, at least one latching recess, but preferably two or three latching recesses per cam, it being possible for one latching recess to be assigned, for example, to a maximum opening position of the associated motor vehicle door and for a further latching recess to be assigned to the closed position of the associated motor vehicle door while further intermediate positions define preferred, partially opened positions of the associated motor vehicle door. It is possible to couple either the cam disk or the latching disk to the shaft section and to pivot it relative to the other disk in each case, which is coupled to a hinge part through which the hinge pin passes with running play. In this case, in the practical implementation, the hinge part will, as a rule, be pivoted relative to the stationary shaft section.

The spring unit of the arrester unit is preferably designed as a helical compression spring which is supported on one side against the disk which is to be carried along by the shaft section and its end which faces away from said disk is supported on a pressure disk which forms an abutment and is arranged preferably in a rotationally fixed manner on the shaft section.

The disk which is carried along by the shaft section preferably comprises an axial, hollow-shaft-like extension which is directed toward the pressure disk and away from the limb and the outer circumference of which forms an insert, which partially passes through the compression spring and centers the latter, and the hollow inner circumference of which is designed for axial, relatively movable, mutual guidance together with the shaft section. In this case, the guidance can take place by means of a polyhedron or axial guide grooves. The hollow shaft is preferably secured against rotation, but can be displaced axially, so that an upward and downward movement of the cam disk is made possible, with corresponding pretensioning of the compression spring, in order to carry out movements when reaching or leaving latching arresting positions.

The disk which is carried along by the shaft section is preferably arranged on the shaft section in a manner such that it can be displaced axially with respect to the shaft section via a guide profile which prevents mutual rotation and preferably engages in the disk and shaft section in an alternating manner, it thereby being assured that said disk has the same orientation as the shaft section. In the case of a shaft section which is carried along by pivoting of the hinge parts, the cam disk is then carried along in accordance with the angled position of the shaft section. In the preferred alternative, the hinge part, which is arranged in a pivoting articulated manner on the shaft section, is rotated away under the disk which is carried along by the shaft section, said disk being moved up along the guide profile counter to the pretensioning of the spring unit and down again owing to the loading of the latter when a latching position in the latching disk has pivoted away under the cam protruding frontally out of the cam disk. The force which is required for the axial displacement and overcomes the pretensioning of the spring constitutes a braking force which is opposed to the pivoting movement of the hinge and has to be overcome during the unlatching operation.

The guide profile of the shaft section is preferably designed as a polygon, it also being possible for the polygon to have rounded corners and vertices. One particularly preferred configuration is that of a polygon configured with a plurality of flanks formed perpendicular with respect to the direction of stress, for example a peripheral tooth profile or rectangular profile which forms vertical guide surfaces or flanks which run essentially radially from the hinge axis or parallel to a radial, an engagement region for a correspondingly protruding profiled design of the disk, for example the cam disk, which is carried along by the shaft being provided between two mutually facing guide surfaces. A correspondingly rounded configuration as a TORX or as an involute profile is likewise possible. This defines a plurality of, preferably six, engagement surfaces which run approximately perpendicular with respect to the tangential introduction of force during rotational actuation, and which, in the case of a rotatable shaft section, ensure the essentially tangential introduction of force on the disk carried along by the shaft section and thereby permit a favorable transfer of force and carrying-along of the disk. However, a rotational movement is preferably not transferred by the shaft section to the disk carried along by the shaft section, and so the disk with the rotational movement, for example the latching disk, and the disk with the axial movement, for example the cam disk, are decoupled and jamming due to a superimposing movement is advantageously avoided.

The predominant part or the entire inner circumference of the hollow-shaft-like extension of the disk which is carried along by the shaft section is preferably formed with a guide profile which is complementary to the guide profile of the shaft section, as a result of which a torsional securing means or a radial carrying-along means is defined which permits axial displacement, but in the unlatching from latching positions does not involve any radial movements or stresses, with the result that no superfluous braking occurs in the axial direction during the radial latching into place or unlatching.

The guide profile of the shaft section is expediently formed over a larger area than the height of the hollow shaft section which is formed with a complementary guide profile and is provided by the disk carried along by the shaft section, which permits an axial displacement at least in the circumference of the protruding cam of the cam disk with guidance reaching at the same time over the entire height of the hollow shaft section.

The disk which is carried along by the shaft section and has a corresponding profiled structure in its hollow shaft section can be formed as a cold extruded part. Another favorable configuration provides a sintered part with which the geometry which is matched to the form-fitting carrying-along or retaining and simultaneous axial guidance of this disk can be produced cost-effectively and at the same time has a low weight and, moreover, defines a material pairing which is low in noise both with respect to the sliding with the other disk and along the hinge pin when these are metal parts. Furthermore, the ends of the spring unit which engages directly on the surface which faces away from the other disk do not need to be protected separately. Particularly if the disk produced as a sintered part is the latching disk, the forming by powder-metallic means enables the difficult configuration of the surface with the latching markings and the torsional securing to be provided on the inside in the hollow shaft section, which surface interacts with the cams, to be realized in one working step, it being possible for the latching recesses to have slightly different widths, for example in order to achieve the effect of a closing aid, without an additional outlay on labor.

The arrester unit expediently comprises a cup-shaped casing which is preferably of water-tight design and is sealed in the impact region with the outer end joint surface by means of an O-ring. Since the compression spring is supported against the pressure disk, the casing can consist of cost-effective materials which are simple to manufacture; in particular, a light-weight sheet-metal material which is too thin for an abutment can be used for this purpose and can have, for example, a water-tight layer vulcanized onto it. This advantageously makes it possible for the casing to be detached without the arrester unit becoming incapable of functioning, and enables, for example, a subsequent lubrication or the like to be provided.

According to a first alternative, a latching disk is arranged in a rotationally fixed manner on the outwardly directed end joint surface of that limb of the hinge part in whose gudgeon the shaft section is held pivotably with a running fit, the latching disk having at least one latching depression in which a latching cam of the cam disk, which cam faces the latching depression, can engage on the relaxation of the spring unit. According to a second alternative, the latching disk and cam disk are interchanged. This makes it advantageously possible to adapt the latching positions defined by the latching depressions in the latching disk as a function of the model selected in each case just by exchange of the latching disk without the hinge part, which can be produced cost-effectively, having to be changed in this case. This advantageously makes possible dimensional degression effects, and, in particular, also the use of sheet-metal shaped parts, the surfaces of which do not require any hardening.

The gudgeons in the hinge part to be fixed on the door pillar are preferably provided in an end of the limbs of its U-shaped sheet-metal shaped part that is remote from the base of said hinge part while the gudgeons on the hinge part to be fixed onto the motor vehicle door are provided in a region of the limbs of the corresponding sheet-metal shaped part that is adjacent to the base of said hinge part. This advantageously enables the hinge axis of the motor vehicle door to be displaced outward in the direction of the door, as a result of which pleasant operating comfort and favorable pivoting paths are ensured.

According to a first preferred improvement of the motor vehicle door hinge according to the invention, the first limb of the first hinge part is connected to the first limb of the second hinge part via a hinge pin stub which is provided outside the shaft section which connects the respective second limbs of the first and of the second hinge parts to each other. Nevertheless, the axes of the shaft section and of the hinge pin stub, which define the pivot axis of the motor vehicle door hinge, are aligned coaxially, thus making possible a smooth-running pivoting movement of the motor vehicle door. The hinge pin stub is preferably designed as a rivet which is held rotatably either directly in the gudgeon of one of the two hinge parts or via a bushing, it being possible for the axial securing of the rivet to be achieved by deformation of its end region. The securing of the two hinge halves via a rivet is cost-effective and at the same time permanent, so that there is no risk of a connecting means gradually becoming loosened.

According to a second preferred improvement of the motor vehicle door hinge according to the invention, the shaft section in the form of a continuous hinge pin passes through all four limbs of the two hinge parts, as a result of which the axis of the shaft section simultaneously defines the pivot axis of the motor vehicle door hinge. For this purpose, the shaft section can be riveted, for axial securing purposes, at its end which faces away from the arrester unit. The shaft section preferably has a stepped cross section which has different, but circular diameters in the regions in which it passes through the gudgeons, so that a favorable, simple process for putting together the arrester unit with the two hinge parts involves the preassembled unit of arrester unit and hinge pin being guided by its end which faces away from the arrester unit through all four gudgeons, it being possible for the graduations in the shaft section to simultaneously form a collar between two mutually facing end joint surfaces, and the end is subsequently riveted. At the same time as providing the nonreleasable connection of the motor vehicle door hinge, this advantageously applies the required pretensioning to the spring unit, and a complicated assembly of the spring unit is not required. The pivoting articulated connections of the two limbs of the two hinge parts are preferably of nonreleasable design in such a manner that unintentional unhinging or losing of parts of the hinge does not occur during assembly.

Further advantages and features of the invention will emerge from the following description and from the claims.

BRIEF DESCRIPTION OF THE DRAWINGS

The invention will be explained in greater detail below using preferred exemplary embodiments and with reference to the attached drawings.

DETAILED DESCRIPTION

Figure 1:
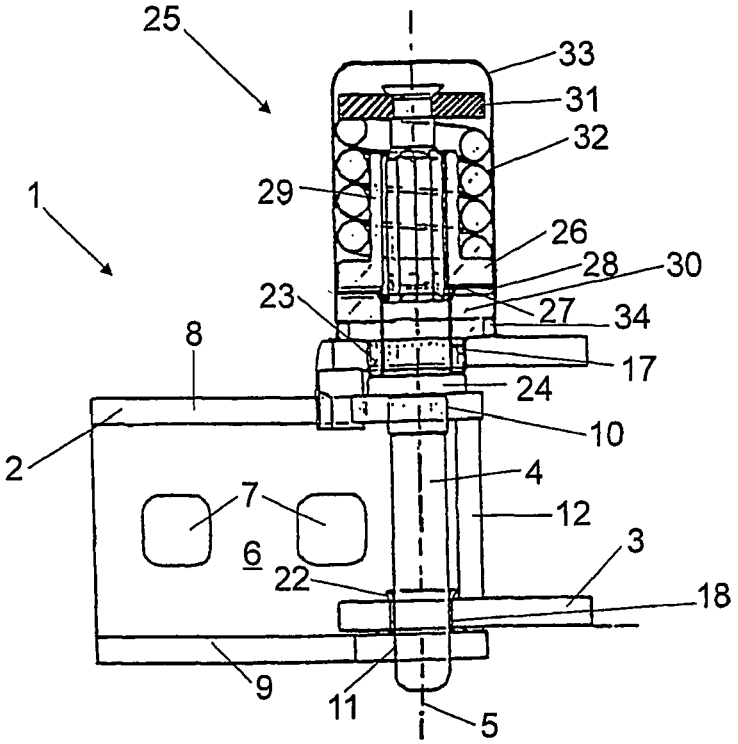
FIG. 1 shows a partially cutaway side view of a first embodiment of a motor vehicle door hinge according to the invention.
Figure 2:
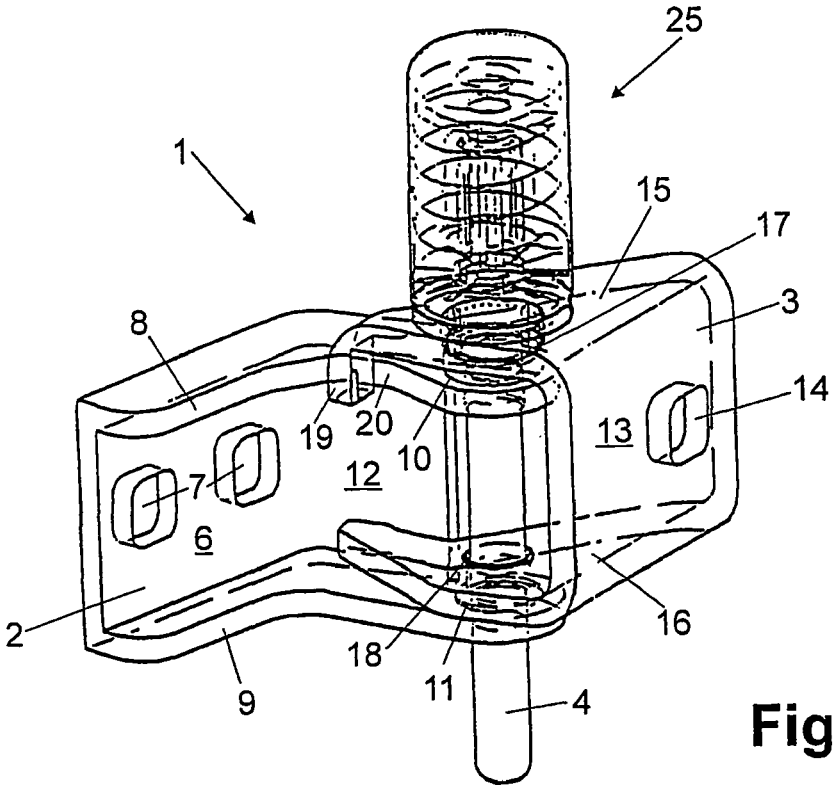
FIG. 2 shows a perspective view of the motor vehicle door hinge from FIG. 1.

The motor vehicle door hinge 1 shown in FIGS. 1 and 2 comprises a first hinge part 2, which can be fastened to a body part, such as a door pillar, and a second hinge part 3, which can be fastened to a motor vehicle door. The first hinge part 2 and the second hinge part 3 are connected to each other in a pivoting articulated manner about a pivot axis 5 via a shaft section 4, which defines a hinge pin.

The first hinge part 2 is designed as a U-shaped sheet-metal folded part and has a base 6 in which two apertures 7 are formed for fixing it to a door pillar, from which base 6 there protrude at right angles an upper limb 8 and a lower limb 9 in which respective round holes 10 and 11 are provided as gudgeons, through which the shaft section 4 passes. Those ends of the two upper and lower limbs 8, 9, in which the round holes 10, 11 are provided, protrude in a manner such that they project for a relatively long distance, to an extent which amounts to more than half of the distance of the two limbs 8, 9 from each other. Between the protruding regions of the upper and lower limbs 8, 9 there furthermore protrudes an edge 12 which protrudes at an angle with respect to the base and results in a favorable stiffening of this region.

The second hinge part 3 is likewise a sheet-metal shaped part which is formed in a U-shape and has a base 13 which is intended for fastening it to a motor vehicle door by means of an aperture 14, an upper limb 15 and a lower limb 16 of the U-shaped hinge part 3 being formed essentially at right angles to the base 13 and having, in a mutually opposite position, respective round holes 17 and 18 which are intended for the passage of the shaft section 4. At its free end which faces away from the base 13, the upper limb 15 of the second hinge part 3 has a bevel 19 which is directed toward the lower limb 16, essentially at a right angle, and which at the maximum opening angle of the motor vehicle door strikes against a stop 20 in the end side of the upper limb 8 of the first hinge part 2 and thereby defines a maximum opening angle of the motor vehicle door hinge 1 or of the motor vehicle door fastened thereto.

It can be seen that the limbs 8, 9 of the first hinge part 2 and the limbs 15, 16 of the second hinge part 3 are designed such that they overlap one another, i.e. in the region of the pivoting joints, the upper limb 15 or the lower limb 16 of the second hinge part 3 is arranged in each case on the same side of the respectively upper limb 8 or lower limb 9 of the first hinge part 2, which results in a compact design of the motor vehicle door hinge 1.

The arrangement of the gudgeons 10, 11 of the first hinge part 2 in a position which is at a large distance from the base 6, and the arrangement of the gudgeons 17, 18 of the second hinge part 3 in a position near to the base 13 thereof has the advantageous effect that the pivot axis 5 of the motor vehicle door which is to be fixed to the second hinge part 3 runs in the vicinity of said door, thereby resulting in favorable operating comfort.

The configuration of the two hinge parts 2, 3 as two-section, U-shaped sheet-metal shaped parts enables the load of the parts which are attached to the motor vehicle door hinge 1 to be distributed favorably to two articulation points, as a result of which the use of sheet-metal shaped parts is economically possible wherever, if single-section hinge parts are used, forged parts would be required because of the torsional and torque loading. In the case of the two-section hinge parts 2, 3, the levers between the stop points, which are defined by the apertures 7 and 14, and the two gudgeons 10, 11 or 17, 18 in each case are small, so that torques have scarcely any adverse effect on the rotational movement and permit a smooth-running opening and closing of a motor vehicle door.

The shaft section 4 is secured in the upper limb 8 of the first hinge part 2 via a knurl 21 and is guided pivotably through a bushing 22 in the lower limb 16 of the second hinge part 3 and a further bushing 23 in the hole 17 in the upper limb 15 of the second hinge part 3. A collar 24 of the shaft section 4 protrudes circumferentially between the limbs 8 of the first hinge part 2 and 15 of the second hinge part 3.

An arrester unit, which is referred to in its entirety by 25, is provided on that side of the upper limb 15 of the second hinge part 3 that faces away from the collar 24, the arrester unit defining, as a function of latching positions which are provided, preferred opening angles of the motor vehicle door hinge 1 or of the motor vehicle door as holding positions. The arrester unit 25 comprises a cam disk 26 which is configured with a central hole through which the shaft section 4 passes and which is secured against rotation via an at least partially extensive connection to the shaft section 4, but permits an axial movement. The cam disk 26 has a flange-like end side 27, from which a cam 28 protrudes frontally, and a hollow-shaft-like section 29 which bears against the shaft section 4, faces away from the end side 27 and the outer circumference of which delimits an annular space from the inside. The end side 27 of the cam disk 26 faces a latching disk 30, which is likewise designed with a central hole in order to allow the shaft section 4 to pass through, but is not connected to the shaft section 4 but rather is secured in a rotationally fixed manner on the upper limb 15 of the second hinge part 3. This means that, owing to a relative pivoting of the first hinge part 2 relative to the second hinge part 3, the rotational movement of the shaft section 4 simultaneously involves a relative rotation of the cam disk 26 and latching disk 30.

At the outer end of the shaft section 4, a pressure disk 31 is arranged on said shaft section and forms an abutment for a compression spring 32, which is of helical design and is supported by its other end on that surface of the cam disk 26 which faces away from the end side 27 and pretensions said cam disk in the direction of the latching disk 30. The pretensioning on account of the compression spring 32 means that, during the pivoting movement of the second hinge part 3 relative to the first hinge part 2, a braking occurs, if the cam 28 leaves a latching position in the latching disk 30, and the spring is relaxed and therefore a preferred, stable holding position is arrived at at an angled position in which the compression spring is relaxed again. This simple mechanism permits the door to be secured in preferred opening positions, it being possible for the preferred opening positions to be changed with little outlay by exchange of the latching disk or of the cam disk.

The arrester unit 25 furthermore comprises a housing 33, which is a thin-walled, cup-shaped sheet-metal part which engages over the cam disk 26, the compression spring 32 and the pressure disk 31 and also over the end of the shaft section 4 and is advantageously secured on an offset of the latching disk 30, and the impact region of which is secured by an O-ring 34. The housing 33 therefore rotates together with the latching disk 30 and the second hinge part 3.

Figure 7:
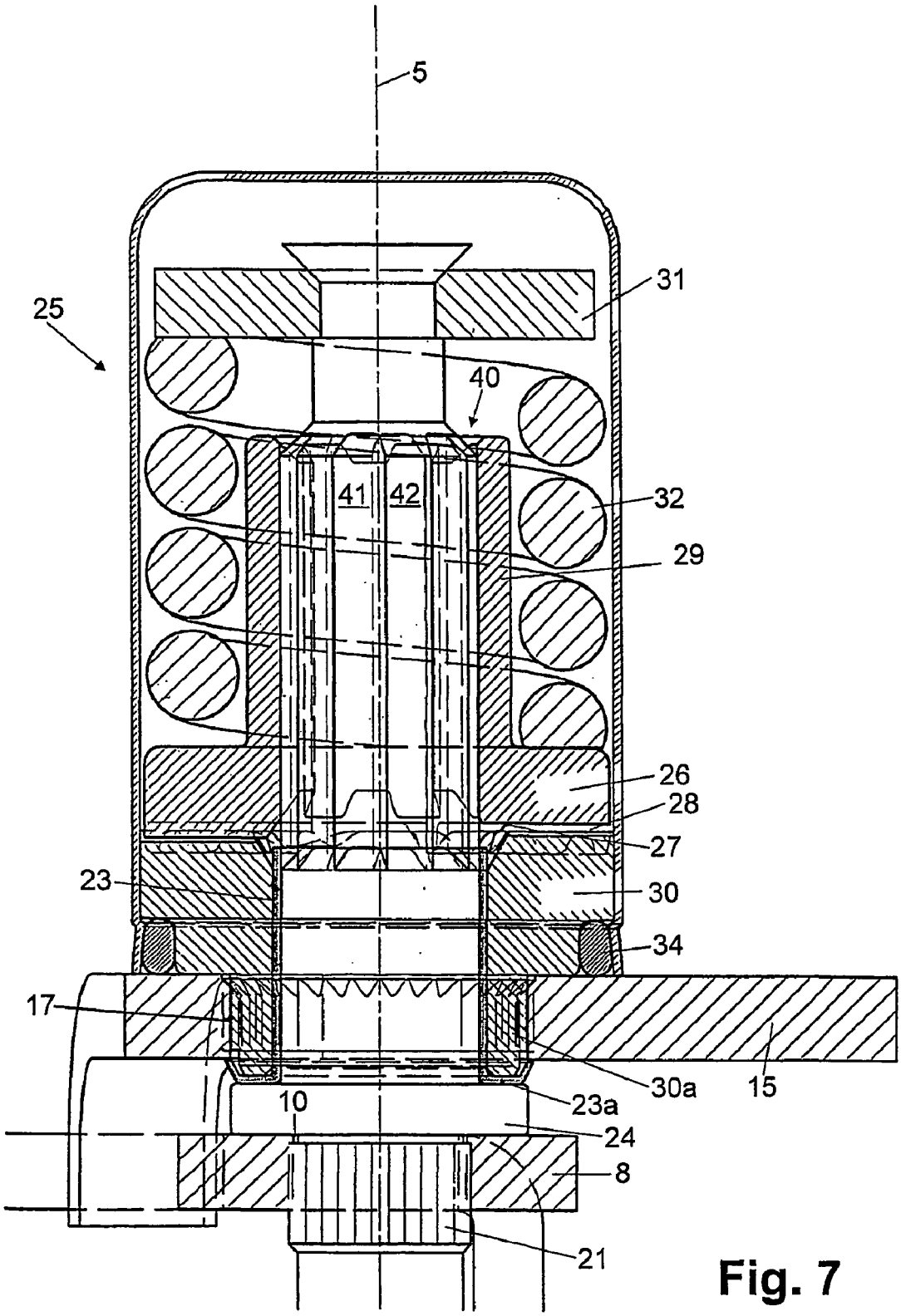
FIG. 7 shows an enlarged, partially cutaway view of the motor vehicle door hinge from FIG. 1 together with details of a plastic bushing.

The upper region of the motor vehicle door hinge 1 can be seen more precisely in detail in partially cutaway form in FIG. 7. It can be seen, in particular, that the bushing 23 completely covers the contact surface of the latching disk 30 with the shaft section 4 and, moreover, has an outwardly angled collar section 23*a* which isolates an end side of an insert 30*a* of the latching disk 30 from the collar 24, the insert 30*a* being pressed into the hole 17 in the upper limb 15 of the second hinge part 3 or being inserted in such a manner that the latching disk 30 is connected in a rotationally fixed manner to the second hinge part 3. The first hinge part is, as explained, connected in a rotationally fixed manner to the shaft section 4 via the knurl 21, so that the bushing 23 obtains particular significance—with respect to the mounting, which is low in bearing movements, and the freedom of play of that region of the shaft section 4 which passes through the bushing 23. In the region of its free end, the collar section 23*a* is set outward again through approximately 60°, with the result that the frontal region of the end side of the insert 30*a* of the latching disk 30, which region protrudes over the hole 17, is likewise covered by the bushing 30 and is therefore shielded from the outside, in particular against impurities and corrosion attacks, in a favorable and dimensionally accurate manner and without being affected by tolerances.

For this purpose, the bushing 23 is first of all press-fitted with an oversize, as a result of which first of all an increased bearing torque arises because of friction. For this purpose, in a first step of a particularly preferred process for producing a motor vehicle door hinge 1 with a defined bearing torque, the bushing 23 is produced by plastic injection molding onto the latching disk 30 before the motor vehicle door hinge 1 is assembled. This advantageously renders a corrosion coating for the latching disk 30 to protect the running surfaces superfluous. This advantageously results in a seamless plastic bushing which has at least approximately uniform properties over its entire circumference. After the motor vehicle door hinge 1 has been assembled, the overdimensioned bearing torque constitutes an increased resistance during opening and closing of the motor vehicle door hinge. In a separate process step, the bearing torque of the bushing 23, which torque is initially overdimensioned in a specific manner, is reduced by heat treatment. For this purpose, use is advantageously made of a surprising effect, according to which, in the assembled state, the stresses in the bushing 23 relax because of the press fit to the shaft section 4, and the bearing torque falls to a desired, low and uniform level, the freedom from play being maintained at the same time in the abovementioned system. The heat treatment may also be brought about by a separate, if appropriate also local, for example inductive, heating. The heat treatment preferably takes place in one working step which is not provided until after the hinge has been fitted into the body shell of a motor vehicle (in which case spare parts are to be treated in a corresponding manner without being fitted) at the same time as the cataphoretic dip coating and subsequent drying, the material of the bushing advantageously being coordinated, for relaxation purposes, with the temperatures which occur during the coating and/or subsequent drying.

The process described above advantageously and directly provides a motor vehicle door hinge—if appropriate fitted in a motor vehicle—which has a play-free bearing point which seals off the mechanism of the arrester unit 25 and at the same time has a low bearing torque which permits a smooth-running pivoting of the motor vehicle door hinge between the latching positions. At the same time, the bushing which is produced by plastic injection molding is far superior in the region of its collar section 23*a*, which is loaded in the axial direction of the motor vehicle door hinge 1 by the compression spring 32 of the arrester unit 25, to a conventional bushing in respect of the uniformity of the geometry, and therefore can more intensely be loaded, as a result of which it is possible to provide sheet-metal folded parts for the hinge halves and at the same time not to have an adverse effect on the running properties of the hinge. The resulting motor vehicle door hinge is thereby more compact and, at the same time, cheaper to manufacture.

The bushing 22 and the hole 18 may also be manufactured in accordance with the bushing 23 explained in detail above.

Figure 3:
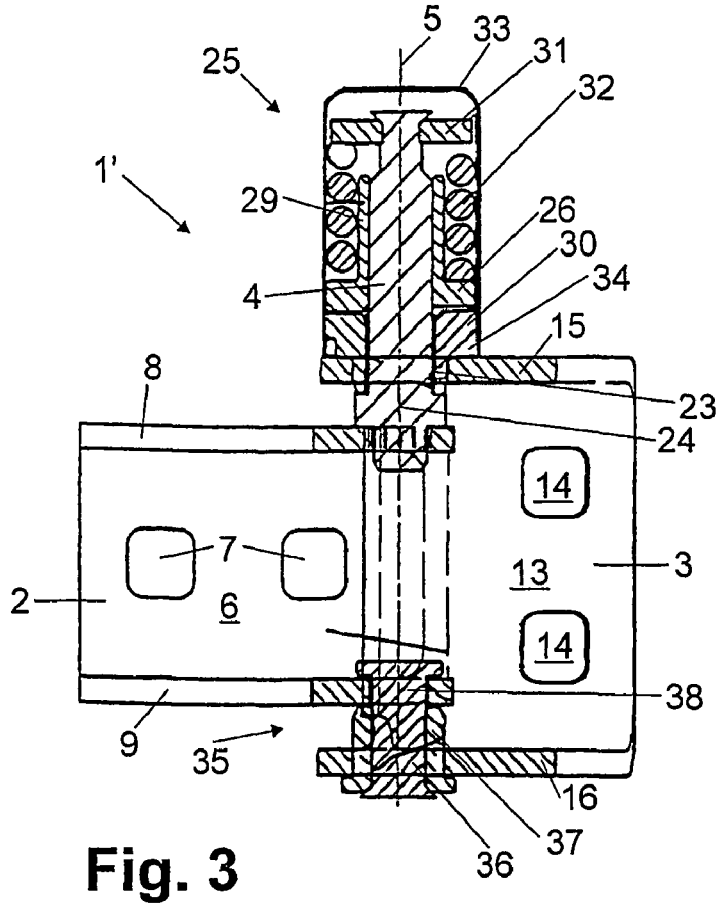
FIG. 3 shows a partially cutaway side view of a second embodiment of a motor vehicle door hinge according to the invention.
Figure 4:
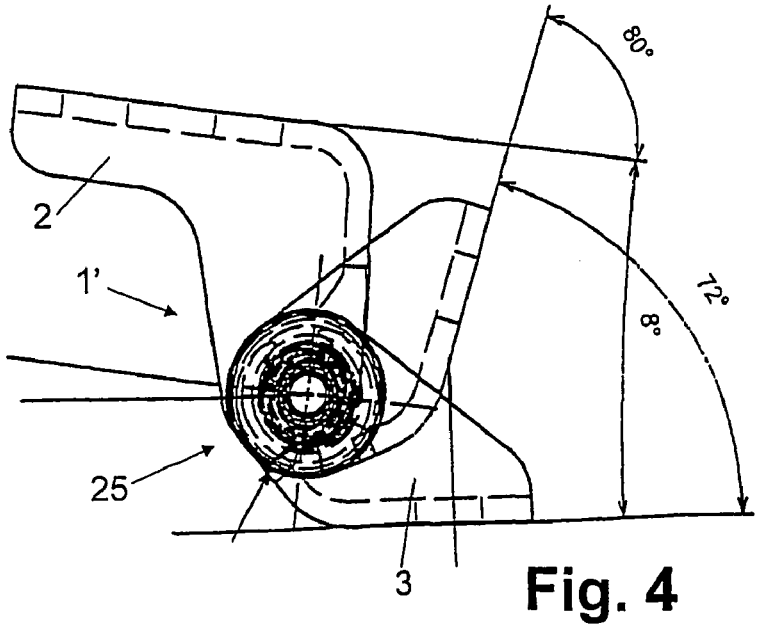
FIG. 4 shows a plan view of the motor vehicle door hinge from FIG. 3.

The motor vehicle door hinge 1' which is shown in FIGS. 3 and 4 differs from the motor vehicle door hinge 1 from FIGS. 1 and 2 essentially by the hinge parts 2 and 3 overlapping in a different way by the two limbs 8, 9 of the first hinge part 2 being articulated on the respectively mutually facing, inner surface of the upper limb 15 and of the lower limb 16 of the second hinge part 3. Furthermore, the shaft section 4 is not formed as a continuous hinge pin but rather, in addition to its function in the arrester unit 25, only connects the joint in the region of the upper limbs 8, 15 of the first and second hinge parts 2, 3. In the description of the motor vehicle door hinge 1', the same reference numbers therefore refer to the same or technically comparable parts as in the motor vehicle door hinge 1 from FIGS. 1 and 2.

The articulated connection between the lower limb 9 of the first stop part 2 on the body and the lower limb 16 of the second door hinge 3 on the door takes place via an articulated connection 35 outside the shaft section 4, which connection will be explained in greater detail below.

The articulated connection 35 as defined by a hinge pin stub which is arranged coaxially on the hinge axis 5, is designed as a rivet 36 and is held in a rotationally fixed manner by means of a hollow rivet 37 in the hole 18 in the lower limb 16 of the second hinge part while that section of the rivet 36 which passes through the hole 11 in the lower limb 9 of the first hinge part 2 is mounted pivotably by means of a bushing 38. The rivet 36 is advantageously secured axially by crimping that section of the rivet 36 protruding over the end joint surface facing away from the limb 16. As an alternative, the articulated connection 35 of the two limbs 9, 16 may also be interchanged.

Figure 5:
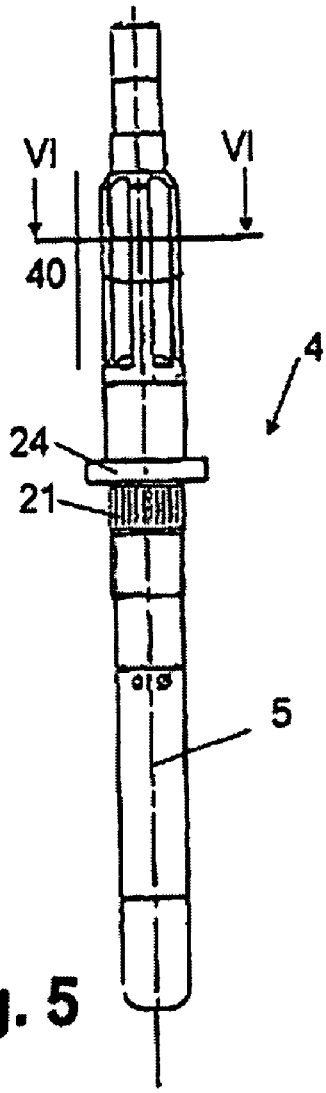
FIG. 5 shows a schematic side view of the shaft section of the motor vehicle door hinge from FIGS. 1 and 2.
Figure 6:
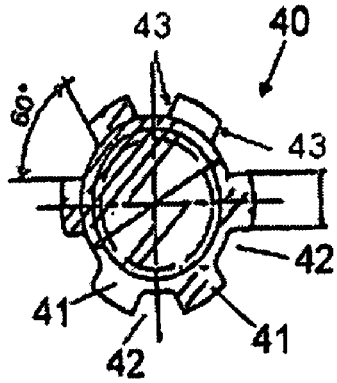
FIG. 6 shows a cross section through the shaft section along the line VI—VI from FIG. 5.

In FIGS. 5 and 6, the shaft section 4 from the motor vehicle door hinge 1 according to FIGS. 1 and 2 is illustrated schematically. Given an appropriate shortening below the circumference knurl 21, a shaft section of corresponding design can also be used in the motor vehicle door hinge 1' from FIGS. 3 and 4.

It can be seen that the shaft section 4 is circumferentially provided with a guide profile 40 in that region in which said shaft section passes through the arrester unit 25 and is surrounded by the hollow shaft section 29, said guide profile comprising a plurality of protruding, rib-like projections 41 and depressions 42 which are defined in between them and form a type of peripheral rectangular tooth profile or trapezoidal tooth profile, this guide profile 40 enabling the cam section 26 to be displaced axially along the hinge axis 5.

The inner circumference of the hollow shaft section 29 of the cam disk 26 is designed with a guide profile which is complementary to the guide profile 40 on the shaft section 4, a torsional securing between the radial flanks 43, which impact against each other in pairs and are directed radially (only the flanks 43 of the guide profile 40 of the shaft section 4 can be seen in FIG. 6) being brought about in a favorable manner at the transition from projections 41 to depressions 42 (and vice versa) of the two guide profiles. Moreover, the cam disk 26 centers itself on the shaft section 4, so that, upon an introduction of force which is brought about by the displacement of the latching disk 30 and is tangential to the shaft section 4, the stressed flanks 43, which are directed in each case in an opposed manner, absorb the forces, with the result that the shaft section 4 absorbs the forces acting on the cam disk 26 over its entire circumference and a favorable distribution of the torques being applied is thereby established.

It can be seen that a total of six projections 41 and six depressions 42 are provided, each having an angled segment of approximately 60°. The projections 41 and depressions 42 are provided lying opposite each other in pairs; as an alternative, however, they may also be provided lying opposite each other with a gap. The depressions 42 define an inside diameter of approximately 9.4 mm and the projections 41 define an external diameter of approximately 12.9 mm, the projections 41 and the depressions 42 being formed such that they lie opposite each other in pairs, as a result of which a comparatively large portion of approximately 30% of the diameter of the shaft section 4 is available as the flank 43 for the resistance against the tangential introduction of force.

The invention has been explained in detail above with reference to two preferred exemplary embodiments. It has to be understood that, in principle, other two-section hinge parts may also be provided according to the invention with an arrester function.

The invention has been explained in detail above with reference to two preferred exemplary embodiments, in which the cam disk 26 is coupled to the shaft section 4 and the latching disk 30 is coupled to the second hinge part 3. It has to be understood that similarly the latching disk 30 can be coupled to the shaft section 4 and the cam disk 26 can be coupled to the second hinge part 3. In both cases, either the first hinge part 2 can be coupled to the door and moved, as a result of which the second hinge part 3 and the associated disk are not moved and the first hinge part 2, the shaft section 4 and the associated disk are moved relative to the second hinge part. However, it is preferred for the door to be fixed onto the second hinge part 3, as a result of which the disk assigned to the shaft section 4 is pivoted up and down and the other disk, which is assigned to the second hinge part 3, is pivoted away below the one disk assigned to the shaft section 4.

What is claimed is:

1. A motor vehicle door hinge, comprising a first hinge part configured to be fixed on one of a door and a door pillar of the motor vehicle, a second hinge part configured to be fixed on the other of the door and the door pillar, said second hinge part being arranged in a manner so as to be pivotable with respect to said first hinge part about a hinge axis, a shaft section, and a door arrester unit including a spring unit, a cam disk and a latching disk, wherein said first hinge part and said second hinge part are each designed as U-shaped sheet-metal shaped parts having a base, a first limb and a second limb, said first limb and said second limb being arranged at a right angle with respect to the base, wherein one gudgeon is arranged on each of said first and second limb of said first hinge part and said second hinge part, wherein the first limb of the first hinge part is connected in an articulated manner to the first limb of the second hinge part, wherein said shaft section connects said gudgeon of said second limb of said first hinge part and said gudgeon of said second limb of said second hinge part in an articulated manner, and wherein a retaining force is generated by said spring unit of the door arrester, wherein a preferred retaining position for the hinge is defined by latching markings in said latching disk, in which at least one immovable cam protruding from said cam disk can engage, wherein one of said cam disk and said latching disk is acted upon by said spring unit and is non-rotatably coupled with said shaft section, and the other of said cam disk and said latching disk is connected in a non-rotatable manner to that hinge part of said first hinge part and said second hinge part in which said shaft section is rotatable, and wherein said one disk is disposed on said shaft section via a circumferential guide profile of the shaft section, which permits axial movement and prevents rotational movement between said one disk and the shaft section, wherein said one disk which is coupled with said shaft section has an axial, hollow-shaft-like extension which ensures, on its inside, a connection to said shaft section and the outer side of which is surrounded by said spring unit, and wherein the predominant part of the inner circumference of the hollow-shaft-like extension is formed by a further guide profile which intermeshes with the guide profile of said shaft section.

2. The motor vehicle door hinge as claimed in claim 1, wherein said arrester unit is attached on one side of one of said first limb and said second limb of said second hinge part facing away from said first hinge part.

3. The motor vehicle door hinge as claimed in claim 1, wherein said spring unit is designed as a compression spring having a first end and a second end, wherein the first end of the compression spring is supported against said one disk which is coupled with said shaft section, and wherein the second end the compression spring is supported against a pressure disk arranged on said shaft section.

4. The motor vehicle door hinge as claimed in claim 1, wherein the guide profile is selected from the group comprising a polygonal, TORX, involute and rectangular profile.

5. The motor vehicle door hinge as claimed in claim 1, wherein the guide profile includes at least four projections which protrude over a circular cross section of the shaft section.

6. The motor vehicle door hinge as claimed in claim 1, wherein the guide profile includes at least four offsets which are set back over a circular cross section of the shaft section.

7. The motor vehicle door hinge as claimed in claim 1, wherein said shaft section in the region of the guide profile has an inner diameter in the region of at least one depression and an outer diameter in the region of at least one projection, the difference between said at least one depression and said at least one projection being between one sixth and a quarter of the inside diameter.

8. The motor vehicle door hinge as claimed in claim 1, wherein the arrester unit comprises a cup-shaped casing.

9. The motor vehicle door hinge as claimed in claim 1, wherein said shaft section is held in said first hinge part and is held in a pivotable manner in said second hinge part.

10. The motor vehicle door hinge as claimed in claim 1, wherein said one of said cam disk and said latching disk coupled to said shaft section is acted upon by said spring unit on a surface facing away from said other of said cam disk and said latching disk.

11. The motor vehicle door hinge as claimed in claim 1, wherein said other of said cam disk and said latching disk comprises an insert inserted in a hole of said first limb of said second hinge part, and wherein said other includes a central passage through which said shaft section passes.

12. The motor vehicle door hinge as claimed in claim 11, wherein a bushing which is produced by injection molding of plastic is arranged in the passage of said other disk and of the insert supporting said shaft section in a manner free from play.

13. The motor vehicle door hinge as claimed in claim 12, wherein the bushing has a collar section, wherein the shaft section has a collar, and wherein the collar section separates the latching disk from the collar.

14. The motor vehicle door hinge as claimed in claim 13, wherein the collar section has a free end which, deposited outward, covers a protruding part of the insert.

15. The motor vehicle door hinge as claimed in claim 12, wherein the bushing is produced by first fitting the bushing with an oversize and compressing the bushing, and then relaxing the bushing by means of heat treatment.

16. The motor vehicle door hinge as claimed in claim 1, wherein the gudgeons in the hinge part which is to be fixed on the door pillar are provided in an end of the limbs that is remote from the base of said hinge part, and wherein the gudgeons in the hinge part to be fixed on the door are provided in a region of the limbs that is adjacent to the base of said hinge part.

17. The motor vehicle door hinge as claimed in claim 1, wherein the limbs of the first hinge part are surrounded by the limbs of the second hinge part.

18. The motor vehicle door hinge as claimed in claim 1, wherein the limbs of the first hinge part and the limbs of the second hinge part intermesh in an alternating manner.

19. The motor vehicle door hinge as claimed in claim 1, wherein the first limb of the first hinge part is connected to the first limb of the second hinge part via a hinge pin stub.

20. The motor vehicle door hinge as claimed in claim 19, wherein the hinge pin stub is designed as a rivet.

21. The motor vehicle door hinge as claimed in claim 19, wherein the hinge pin stub is held rotatably in the first hinge part, and is held in the second hinge part by means of a hollow rivet.

22. The motor vehicle door hinge as claimed in claim 1, wherein the first hinge part is connected to the second hinge part via a shaft section which passes through all four limbs.

23. The motor vehicle door hinge as claimed in claim 22, wherein the shaft section has a stepped cross section.

24. The motor vehicle door hinge as claimed in claim 22, wherein the shaft section is secured in the two gudgeons of the first hinge part and passes through the two gudgeons of the second hinge part with running play.

25. The motor vehicle door hinge as claimed in claim 1, wherein one of the limbs of the first and second hinge part further defines together with one end an end stop.

26. The motor vehicle door hinge as claimed in claim 1, wherein the latching disk and the cam disk are arranged perpendicular on the hinge axis.

27. The motor vehicle door hinge as claimed in claim 1, wherein the at least one cam of the cam disk extend radially from the hinge axis in the cam disk.

28. The motor vehicle door hinge as claimed in claim 1, wherein said one disk coupled with said shaft section is a single-piece sintered part.

29. The motor vehicle door hinge as claimed in claim 1, wherein the base of the first hinge part and the base of the second hinge part each has apertures for fixing it onto the door assembly parts.

30. A motor vehicle door hinge, comprising:

a first hinge part configured to be fixed on one of a door and a door pillar of the motor vehicle, a second hinge part configured to be fixed on the other of the door and the door pillar, said second hinge part being arranged in a manner so as to be pivotable with respect to said first hinge part about a hinge axis, a shaft section, and a door arrester unit including a spring unit, a cam disk and a latching disk, wherein said first hinge part and said second hinge part are each designed as U-shaped sheet-metal shaped parts having a base, a first limb and a second limb, said first limb and said second limb being arranged at a right angle with respect to the base, wherein one gudgeon is arranged on each of said first and second limb of said first hinge part and said second hinge part, wherein the first limb of the first hinge part is connected in an articulated manner to the first limb of the second hinge part, wherein said shaft section connects said gudgeon of said second limb of said first hinge part and said gudgeon of said second limb of said second hinge part in an articulated manner, and wherein a retaining force is generated by said spring unit of the door arrester, wherein preferred retaining positions for the hinge are defined by latching markings in said latching disk, in which at least one immovable cam protruding from said cam disk can engage, and wherein one of said cam disk and said latching disk is acted upon by said spring unit and is non-rotatably coupled with said shaft section, and the other of said cam disk and said latching disk is connected in a non-rotatable manner to that hinge part of said first hinge part and said second hinge part in which said shaft section is rotatable, wherein said one disk has an axial, hollow shaft-like extension providing a connection to said shaft section, wherein said one disk is arranged on said shaft section via a circumferential guide profile of the shaft section, which permits axial movement and prevents rotational movement between said one disk and the shaft section wherein the predominant part of the inner circumference of the hollow-shaft-like extension is formed by a further guide profile which intermeshes with the guide profile of said shaft section.

31. The motor vehicle door hinge as claimed in claim 30, wherein the guide profile of said shaft section covers a larger length than the height of the further guide profile of the hollow-shaft-like extension.

32. A motor vehicle door hinge, comprising:

a first hinge part configured to be fixed on one of the door and the door pillar of a vehicle, said first hinge part comprising at least one gudgeon, a second hinge part configured to be fixed on the other of the door and the door pillar, said second hinge part comprising at least one gudgeon, a shaft section, wherein said shaft section connects said at least one gudgeon of said first hinge part and said at least one gudgeon of said second hinge part, wherein said shaft section is non-rotatably held in one of said first hinge part and said second hinge part and rotatably received in the other of said first hinge part and said second hinge part, a spring unit, a cam disk comprising at least one protruding immovable cam, and a latching disk having a plurality of latching markings in which said at least one protruding immovable cam can engage, wherein one of said cam disk and said latching disk is acted upon by said spring unit and is non-rotatably coupled with said shaft section while the other of said cam disk and said latching disk is connected in a non-rotatable manner to said other of said first hinge part and said second hinge part in which said shaft section is rotatably received, wherein said one disk being coupled with said shaft section has an axial, hollow-shaft-like extension which ensures, on its inside, a connection to the shaft section having a circumferential guide profile, and wherein the guide profile includes at least four projections which protrude over a circular cross section of the shaft section, wherein the guide profile includes at least four offsets which are set back over a circular cross section of the shaft section, wherein the guide profile of said shaft section has an inner diameter in the region of said offsets and an outer diameter in the region said projections, and wherein a difference between said outer diameter and said inner diameter lies between one sixth and one quarter of said inner diameter.

33. The motor vehicle door hinge as claimed in claim 32, wherein the outer side of said hollow-shaft-like extension is surrounded by said spring unit.

34. The motor vehicle door hinge as claimed in claim 32, wherein said one disk is disposed displaceably on said shaft section via the circumferentially arranged guide profile which prevents mutual rotation.

35. The motor vehicle door hinge as claimed in claim 34, wherein the predominant part of the inner circumference of the hollow-shaft-like extension is formed by a further guide profile which intermeshes with the guide profile of said shaft section.

36. The motor vehicle door hinge as claimed in claim 35, wherein the guide profile of said shaft section covers a larger length than the height of the further guide profile of the hollow-shaft-like extension.

37. The motor vehicle door hinge as claimed in claim 32, wherein said one disk which is coupled with said shaft section cooperates with the one of said first hinge part and said second hinge part which cooperates with the door pillar, and that said other disk cooperates with the other of said first hinge part and said second hinge part which cooperates with the door, such that a rotational movement of the door leads to a rotational movement of said other disk, such that when said at least one protruding immovable cam enters or leaves one of said plurality of latching markings, said one disk executes an axial movement, said axial movement resulting in one of compressing and relaxing said spring unit.

* * * * *